US005783109A

United States Patent [19]

Sawhney

[11] Patent Number: 5,783,109

[45] Date of Patent: Jul. 21, 1998

[54] DISPERSION OF GUMS AND IRON SULFIDE IN HYDROCARBON STREAMS WITH ALKYL PHENOL-POLYETHYLENEPOLYAMINE FORMALDEHYDE RESINS

[75] Inventor: Kailash N. Sawhney, Sugar Land, Tex.

[73] Assignee: Nalco/Exxon Energy Chemicals, L.P., Sugar Land, Tex.

[21] Appl. No.: 701,466

[22] Filed: Aug. 21, 1996

Related U.S. Application Data

[63] Continuation of Ser. No. 298,732, Aug. 31, 1994, abandoned, which is a continuation-in-part of Ser. No. 235,050, Apr. 29, 1994, Pat. No. 5,494,607.

[51] Int. Cl.[6] ..... B01J 13/00; C10G 9/16; F21B 43/28

[52] U.S. Cl. ..... 252/314; 208/48 AA; 252/309; 252/357; 507/90

[58] Field of Search ..... 252/309, 314, 252/357; 208/48 R, 48 AA; 507/90

[56] References Cited

U.S. PATENT DOCUMENTS

| | | | |
|---|---|---|---|
| 2,962,442 | 11/1960 | Andress, Jr. . | |
| 3,105,810 | 10/1963 | Miller et al. | 208/48 AA |
| 3,127,344 | 3/1964 | De Groote et al. . | |
| 3,127,345 | 3/1964 | De Groote et al. . | |
| 3,261,774 | 7/1966 | Newkirk et al. | 208/48 AA |
| 3,278,637 | 10/1966 | Kirkpatrick et al. | 525/496 |
| 3,437,583 | 4/1969 | Gonzalez | 208/48 AA |
| 3,776,835 | 12/1973 | Dvoracek | 208/48 AA |
| 4,005,020 | 1/1977 | McCormick . | |
| 4,207,193 | 6/1980 | Ford et al. . | |
| 4,592,759 | 6/1986 | Naka et al. | 252/357 X |
| 4,749,468 | 6/1988 | Roling et al. | 208/48 AA |
| 4,830,740 | 5/1989 | Klimpel et al. | 209/167 |
| 4,900,427 | 2/1990 | Weers et al. | 208/48 AA |
| 4,931,164 | 6/1990 | Dickakian | 208/48 AA |
| 4,997,580 | 3/1991 | Karydas et al. | 137/13 X |
| 5,021,498 | 6/1991 | Stephenson | 524/484 |
| 5,073,248 | 12/1991 | Stephenson | 208/22 |
| 5,100,531 | 3/1992 | Stephenson | 208/22 |
| 5,112,505 | 5/1992 | Jacobs et al. . | |
| 5,143,594 | 9/1992 | Stephenson et al. | 208/48 AA |
| 5,232,963 | 8/1993 | Comer et al. | 524/55 |
| 5,494,607 | 2/1996 | Manek et al. | 252/308 |

*Primary Examiner*—Richard D. Lovering

*Attorney, Agent, or Firm*—Elaine M. Ramesh; Thomas M. Breininger

[57] ABSTRACT

Gums and inorganic corrosion byproducts occurring in distilled petroleum fractions may be dispersed and resulting fouling controlled by adding to the petroleum distillate an effective dispersing amount of a monosubtituted alkylphenol polyethylenepolyamine-formaldehyde resin, such resins having a weight average molecular weight of from about 1,000 to about 10,000, and an alkyl substituent containing from about 4 to about 24 carbon atoms, which alkyl substituent may be a linear or branched.

5 Claims, No Drawings

DISPERSION OF GUMS AND IRON SULFIDE IN HYDROCARBON STREAMS WITH ALKYL PHENOL-POLYETHYLENEPOLYAMINE FORMALDEHYDE RESINS

This application is a continuation of application Ser. No. 08/298,732 filed Aug. 31, 1994, now abandoned, which is in turn a continuation-in-part of application Ser. No. 08/235,050, filed Apr. 29, 1994, now issued U.S. Pat. No. 5,494,607.

FIELD OF THE INVENTION

This invention relates to the prevention of fouling caused by gums and inorganic corrosion byproducts in the refining of petroleum distillates through the use of certain alkylphenol-polyethylenepolyamine-formaldehyde resins.

INTRODUCTION

Instability of hydrocarbon streams under both storage and processing conditions is becoming of increasing concern to refiners. Degradation of these streams under processing conditions manifests itself in a variety of ways including color change, formation of soluble and/or insoluble gums, and development of particulate matter. Development of particulate matter followed by sediment deposit can result in reduced throughput and reduction in the efficiency of the heat transfer surface area in heat exchangers, leading to operational difficulties.

Process additives are used to control the deposition and fouling potential of gums and inorganic corrosion byproducts, especially iron sulfide in the processing of refined petroleum products. The processing of petroleum distillates is greatly enhanced by the use of the gum and inorganic corrosion product dispersants disclosed herein which can be used to prevent deposition throughout the entire processing process. The antifoulants utilized are alkylphenol-polyethylenepolyamine-formaldehyde resins, wherein the alkyl group contains from 4–24 carbon atoms, and wherein the polyethylenepolyamine is represented by the formula $H_2N—(CH_2—CH_2—NH—)_nH$, where "n" is an integer of from 1 to 5.

DESCRIPTION OF THE INVENTION

The deposition of gums and inorganic corrosion products such as iron sulfide onto heat exchangers, tubes, pipes, and the like in the refining of petroleum products is troublesome.

Gums generally include the adhesive oligomeric products of gum-forming (e.g. polymerizable) hydrocarbon and hydrocarbon derivative streams, and generally have a molecular weight of from about 50 to about 100,000. Gums are usually oxidized products formed from hydrocarbons which are not stabilized with antioxidants. They typically contain heteroatoms such as oxygen, nitrogen, or sulfur, which confer polarity. The inorganic corrosion byproducts which are dispersed in hydrocarbon streams by the additive of this invention include various iron salts, including iron oxide, and especially iron sulfide. While these inorganic materials may be present as corrosion byproducts, they may also be present naturally in the feedstock being treated. Inorganic materials, occurring both naturally, and as corrosion byproducts may be dispersed utilizing the dispersant of this invention.

The dispersant of this invention has been disclosed to be a useful dispersant for asphaltene materials occurring in crude oils in copending application Ser. No. 08/235,050 filed Apr. 29, 1994 now U.S. Pat. No. 5,494,607 which is hereinafter incorporated by reference into this specification.

Asphaltenes found in crude oil tend to be condensed naturally formed heterocyclic compounds, while gums found in distillates and in the processing of distillates tend to be polymerization products, and are not necessarily aromatic in nature. We have now found that some of the materials described in our earlier filed application also provide superior performance in the dispersion of gums and inorganic materials in the processing of hydrocarbons.

OBJECTS OF THE INVENTION

It is accordingly an object of this invention to provide to the art a novel method for the dispersion of gums and inorganic corrosion products in the processing of gum forming petroleum distillates.

It is a further object of this invention to provide to the art a method for the prevention of fouling on processing equipment in contact with gum forming petroleum distillates. It is a still further object of this invention to provide to the art a novel method for preventing the fouling of processing equipment in contact with gum forming petroleum distillates.

It is yet a further object of this invention to provide to the art a method for the dispersion of inorganic corrosion byproducts in petroleum distillates containing such corrosion byproducts.

Further objects will appear hereinafter.

DETAILED DESCRIPTION OF THE INVENTION

As set forth above, this invention relates to a method of dispersing gums and inorganic corrosion byproducts, especially iron sulfide in petroleum distillates, or in any fraction thereof which comprises adding to the petroleum distillate an effective dispersing amount of a gum and inorganic corrosion byproduct dispersant to the distillate at any point in its processing or subsequent storage.

THE DISPERSANT

The dispersant added to the petroleum distillate in accordance with this invention comprises a monosubstituted alkylphenol-polyethylenepolyamine-formaldehyde resin, said resin having a weight average molecular weight of from about 1,000 to about 10,000, an alkyl substituent containing from about 2 to about 24 carbon atoms and preferably from 4 to 12 carbon atoms. The alkyl substituent may be a linear or branched alkyl group, and wherein the polyethylenepolyamine is represented by the formula $H_2N—(CH_2—CH_2—NH—)_nH$ where "n" is an integer of from 1 to 5 and preferably from 1 to 3.

In a preferred embodiment of this invention, the monosubstituted alkylphenol-polyethylenepolyamine-formaldehyde resin is a resin derived from a base catalyzed reaction of the mixture of nonylphenol and a polyethylenepolyamine with phenol to amine molar ratio of 5:1 to 3:1, and the combined phenol-amine to formaldehyde ratio of from about 2:1 to 1:2, which resin has a weight average molecular weight of about 1,000 to about 10,000.

Specific examples of gum-forming refinery streams or petroleum distillates which may be treated using the process of this invention include streams containing naphtha, kerosene, diesel, gas oil, and the like. The present invention is generally applicable to gum forming hydrocarbons and mixtures found, for example in various refinery units such as hydrodesulfurizers, reformers, hydrocrackers and recovery units such as depropanizers and debutanizers.

Using the present invention, gum formation can be inhibited in hydrocarbons in process equipment including, for example, coolers, heat exchangers, reboilers, compressors, distillation towers (such as those used as depropanizers, debutanizers, and the like). By not only acting to disperse the gum forming constituents, but also acting to disperse inorganic corrosion byproducts such as iron sulfide, which readily attach to gums, processes run more efficiently, with improved heat transfer efficiency.

The dispersant of the present invention is also useful in the dispersion of inorganic corrosion byproducts such as iron sulfide in hydrocarbon streams. In untreated streams, iron salts, and especially iron sulfide may precipitate in lines and equipment causing operational difficulties, poor heat transfer, and/or excessive maintenance problems. When inorganic corrosion byproducts are present with gums, they may adhere to the gums coating lines and equipment adding to the deposition, and increasing the problem that either gums or inorganic corrosion byproducts may pose in and of themselves.

The present dispersant is typically added to a continuous process stream at a point of relatively low pressure to achieve a desired equilibrium concentration throughout the process. In processes where gaseous and liquid reactants, products and/or solvents are heated or cooled, e.g., in recovery operations for recycle and reuse following product finishing steps, the present dispersant is preferably added upstream of heat exchangers or coolers.

The present dispersant can be used as a continuous additive in the hydrocarbon stream, or it can be added periodically to facilitate gum and/or inorganic corrosion byproduct removal from the process equipment.

Dispersion of gums and inorganics in polymerizable hydrocarbon streams are produced by admixing an effective amount of the monosubstituted alkyl phenol-polyethylenepolyamine formaldehyde resin into the hydrocarbon stream. The dispersant is effective at dispersing oligomeric gums in the treated organic phase so as to prevent or inhibit build-up of gum and inorganic corrosion byproducts in equipment designed for compressing, heating, cooling and reacting these hydrocarbon streams. The dispersant is used at a concentration of from about 0.1 to about 2000 parts per million of the hydrocarbon stream, more preferably from about 1 to about 10 parts per million, and most preferably from about 1 to about 5 parts per million. Dispersions may be achieved at a stream temperature as low as about −10° C. up to about 500° C., but preferably from about 0° C. to about 400° C.

In the practice of the present invention, the monosubstituted alkyl phenol-polyethylenepolyamine-formaldehyde resin can be the sole dispersant or may be admixed with other compounds known to have effect in the dispersion of gums and inorganic materials in petroleum streams. Examples of other additives with which the dispersant of this invention may be mixed include lipophilic-hydrophilic vinyl polymers such as those described in U.S. Pat. No. 5,232,963 which is hereinafter incorporated by reference into this specification.

In order to exemplify the resins of this invention, the following examples are presented:

EXAMPLES 1–3

Dispersion tests were conducted on several different gum materials using nonylphenol-diethylenetriamine-formaldehyde resin as the dispersing agent. A typical procedure for the synthesis of the nonylphenol-diethylenetriamine-formaldehyde resin is described as follows:

SYNTHESIS OF NONYLPHENOL-DIETHYLENETRIAMINE-FORMALDEHYDE RESIN

Nonylphenol (250.95 g), and aromatic solvent S (150.0 g.) were taken in a 1 liter 4-necked flask fitted with a reflux condenser, mechanical stirrer, and a temperature control. The contents of the flask were heated to 80° C., when 17.83 g. (⅓ of 53.50 g.) of paraformaldehyde and 25.05 g. of diethylenetriamine were added. The reaction was associated with the generation of heat and the temperature of the reaction began to rise. A cold water bath was applied to keep the reaction temperature below 100° C. A second lot of paraformaldehyde (17.84 g.) was added when the temperature dropped below 80° C. The reaction temperature was maintained (water bath) below 100° C. The remaining paraformaldehyde was added when the temperature was below 80° C. After the exotherm had subsided, the temperature of the reaction mixture was held at ~100° C. for 2 hours.

A Dean Stark tube was attached and the temperature was raised slowly to 150° C. and the azeotroped water and hydrocarbon solvent were collected. Water (20.5 g.) and hydrocarbon solvent (9.5 g.) were collected during this period (~1 hour). The reaction was then set for high temperature rise at 200° C. Samples of reaction mixture were taken at 30, 60, and 90 minute intervals and analyzed for the weight average molecular weight by GPC. The reaction was stopped (~2 hours) when the desired molecular weight (1800–2000) was attained. A total of 32.0 g. of water and 30.0 g. of hydrocarbon solvent were collected in the Dean Stark tube at the end of the reaction. Aromatic solvent (30.0 g.), equivalent to the amount of hydrocarbon azeotroped was added and the reaction was cooled to room temperature to give the desired resin.

Gums samples were available as the residue of gum testing procedures performed at the plant streams according to the ASTM D-873. Feedstocks used for generating gums were 1) for gum X: diesel, 2) for gum Y: coker naphtha, and 3) for gum Z: flexi coker debutanizer bottoms.

A saturated stock solution containing the gums sample was prepared by dissolving the solid or semisolid gum in a minimum amount of toluene.

The dispersant solution was prepared by dissolving the resin dispersant to give a one percent solution (by volume) in toluene. Other dispersant or additive compounds used were similarly prepared in toluene. Table 1 lists the dispersant components.

TABLE 1

| Compound | Composition |
|---|---|
| A | nonylphenol-diethylenetriamine-formaldehyde resin |
| B | nonylphenol-formaldehyde polymer |
| C | poly(isobutenyl) succinimide |

Tests were run by adding 175 μL of a stock solution to a graduated centrifuge tube containing an appropriate amount of dispersant solution diluted by 10 mL of hexane. After agitation for 60 seconds, the tube was allowed to settle for 30 minutes. After settling, the volume of any solid material at the bottom of the tube was measured and compared to the volume of the settled material in a control sample of stock solution containing no dispersant. Percent dispersion for each test is presented in Table 2 as the percent difference of the volume of the non-dispersed material. Results indicate excellent dispersant activity using the nonylphenol-diethylenetriamine-formaldehyde dispersant.

TABLE 2

| | Composition of Dispersant Additives (ppm) | | | | |
|---|---|---|---|---|---|
| Example | Cpd. A | Cpd. B | Cpd. C | Gum Type | Percent |
| 1 | 500 | | | X | 100 |
| | | 500 | | X | 56 |
| | | | 500 | X | 99 |
| | 250 | | | X | 96 |
| | | 250 | | X | 30 |
| | | | 250 | X | 76 |
| 2 | 500 | | | Y | 64 |
| | | 500 | | Y | 51 |
| | | | 500 | Y | 33 |
| 3 | 500 | | | Z | 100 |
| | | 500 | | Z | 45 |
| | | | 500 | Z | 40 |

TABLE 3

| EXAMPLE | DISPERSANT | DOSAGE (PPM) | COMMENTS |
|---|---|---|---|
| | Blank | — | Fail |
| 4 | A | 500 | Fail |
| | | 600 | Fail |
| | | 700 | Fail |
| | | 800 | Pass |
| | | 900 | Pass |
| | | 1000 | Pass |
| | | 1500 | Pass |
| | | 2000 | Pass |
| 5 | C | 500 | Fail |
| | | 600 | Fail |
| | | 700 | Fail |
| | | 800 | Fail |
| | | 900 | Pass |
| | | 1000 | Pass |
| | | 1500 | Pass |
| | | 2000 | Pass |

Analysis of the results presented in Table 3 indicate that the dispersant of present invention (i.e., dispersant A) is more effective than the conventional product.

EXAMPLES 4–5

The 10% solutions (weight/weight) of nonylphenol-diethylene-triamine-formaldehyde resin (compound A) and the conventional poly(isobutenyl) succinic dispersant (Compound C), prepared in aromatic solvent were tested and compared utilizing the following procedure.

a. Ten milliliters of a saturated solution of hydrogen sulfide in hexane was taken in centrifuge tubes (12.5 ml).

b. Each tube was dosed with varying amounts of dispersants leaving one as blank.

c. Two hundred μL of a 15% ferric naphthenate solution in toluene, are added to each tube to form iron sulfide.

d. After 10 minutes the tubes are centrifuged at 2000 rpm for one minute.

e. The various dosage levels of each dispersant are evaluated on a pass/fail basis. If iron sulfide is observed at the bottom of the tube, the dispersant, at that dosage, is a failure.

I claim:

1. A method for preventing deposition of iron salt corrosion byproducts selected from the group consisting of iron oxide and iron sulfide in petroleum distillates on petroleum processing equipment, wherein said by-products are formed as a result of petroleum processing, which comprises adding an effective deposit-inhibiting amount of a resin to said petroleum distillate, the resin comprising a monosubstituted alkylphenol-polyethylenepolyamine-formaldehyde resin having a weight average molecular weight of from about 1,000 to about 10,000, and an alkyl substituent containing from about 4 to about 24 carbon atoms, which alkyl substituent may be a linear or branched alkyl group and wherein the polyethylenepolyamine is represented by the formula $H_2N—(CH_2—CH_2—NH—)_nH$ where n is an integer of from 1 to 5.

2. The method of claim 1 wherein the alkyl substituent contains 9 carbon atoms.

3. The method of claim 1 wherein in the formula $H_2N—(CH_2—CH_2—NH—)_nH$, n is 2.

4. The method of claim 1 wherein the monosubstituted alkylphenol-polyethylenepolyamine-formaldehyde resin is a resin derived from a base catalyzed reaction of the mixture of nonylphenol and polyethylenepolyamine with phenol to amine molar ratio of 5:1 to 3:1, and the combined phenolamine to formaldehyde ratio of from about 2:1 to 1:2, which resin has a weight average molecular weight of about 1,000 to about 10,000.

5. The method of claim 1 wherein the petroleum processing equipment is selected from the group consisting of coolers, heat exchangers, reboilers, compressors and distillation towers.

* * * * *